US010287688B2

(12) United States Patent
Hiei et al.

(10) Patent No.: US 10,287,688 B2
(45) Date of Patent: May 14, 2019

(54) PLATING METHOD

(71) Applicant: TOYODA GOSEI CO., LTD., Kiyosu-shi, Aichi-ken (JP)

(72) Inventors: Takao Hiei, Kiyosu (JP); Atsushi Kawahara, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 282 days.

(21) Appl. No.: 15/051,746

(22) Filed: Feb. 24, 2016

(65) Prior Publication Data

US 2016/0258066 A1 Sep. 8, 2016

(30) Foreign Application Priority Data

Mar. 6, 2015 (JP) ..... 2015-044836

(51) Int. Cl.
*C23C 28/00* (2006.01)
*C23C 28/02* (2006.01)
(Continued)

(52) U.S. Cl.
CPC ..... *C23C 18/1671* (2013.01); *C23C 18/163* (2013.01); *C23C 18/1619* (2013.01); *C23C 18/1632* (2013.01); *C23C 18/1653* (2013.01); *C23C 28/023* (2013.01); *C25D 17/00* (2013.01); *C25D 17/005* (2013.01); *C25D 17/06* (2013.01); *C25D 17/12* (2013.01); *C23C 18/2086* (2013.01); *C23C 18/24* (2013.01); *C23C 18/285* (2013.01); *C23C 18/30* (2013.01); *C23C 18/32* (2013.01); *C25D 5/14* (2013.01)

(58) Field of Classification Search
CPC ..... C23C 28/02; C23C 18/1653; C23C 28/00
USPC ..... 205/183, 187
See application file for complete search history.

(56) References Cited

U.S. PATENT DOCUMENTS 4,391,841 A * 7/1983 Zeblisky ..... C23C 18/1623 118/70
4,673,469 A * 6/1987 Beach ..... C25D 5/56 205/167

(Continued)

FOREIGN PATENT DOCUMENTS

JP 2001-073198 A 3/2001
JP 2004-068107 A 3/2004

*Primary Examiner* — Edna Wong
(74) *Attorney, Agent, or Firm* — Posz Law Group, PLC

(57) ABSTRACT

A plating method has an electroless plating step for forming a conductive coating on a non-conductive substrate and an electrolytic plating step for forming a metallic coating on the conductive coating by using an auxiliary electrode. In the electroless plating step, with the position of the auxiliary electrode adjusted in relation to the non-conductive substrate, the non-conductive substrate and the auxiliary electrode are both immersed in an electroless plating solution to form the conductive coating. In the electrolytic plating step, with the position of the auxiliary electrode adjusted in relation to the non-conductive substrate, the non-conductive substrate and the auxiliary electrode are both immersed in an electrolytic plating solution to form the metallic coating. In the electroless plating step, electric current is applied by using the auxiliary electrode as an anode and a conductive member immersed in the electroless plating solution as a cathode.

8 Claims, 7 Drawing Sheets

(51) Int. Cl.

| | |
|---|---|
| ***C23C 18/16*** | (2006.01) |
| ***C25D 17/00*** | (2006.01) |
| ***C25D 17/06*** | (2006.01) |
| ***C25D 17/12*** | (2006.01) |
| *C23C 18/30* | (2006.01) |
| *C23C 18/32* | (2006.01) |
| *C25D 5/14* | (2006.01) |
| *C23C 18/20* | (2006.01) |
| *C23C 18/24* | (2006.01) |
| *C23C 18/28* | (2006.01) |

(56) References Cited

U.S. PATENT DOCUMENTS

| | | | | |
|---|---|---|---|---|
| 6,348,138 | B1 | 2/2002 | Yoshimura et al. | |
| 6,409,902 | B1 * | 6/2002 | Yang | B22C 9/061 205/67 |
| 6,923,898 | B2 | 8/2005 | Yoshimura et al. | |
| 2009/0232999 | A1 * | 9/2009 | Micyus | C23C 18/1617 427/438 |

* cited by examiner

PLATING METHOD

BACKGROUND OF THE INVENTION

The present invention relates to a plating method for forming a metallic coating on a substrate.

As car accessories such as radiator grilles, back panels, and fog lamp covers having a metallic appearance and provided to automobiles, those manufactured by forming a metallic coating on a substrate are often used. As a method for manufacturing such a car accessory, a plating method is known, in which a conductive coating is formed on a substrate made of a plastic by electroless plating to impart conductivity, followed by forming a plurality of metal-coating layers by electrolytic plating.

FIG. 5 shows a part of the plating step. As a plastic substrate, for example, a substrate made of an acrylonitrile-butadiene-styrene copolymer (ABS) plastic is used. First, the plastic substrate is subjected to a preprocessing step to impart conductivity to the substrate. The preprocessing step includes a degreasing step, an etching step, a catalyst step, an accelerator step, and an electroless nickel plating step.

In the degreasing step, the ABS plastic substrate is subjected to a degrease treatment to remove fats and oils adhered to the surface thereof. In the etching step, the surface of the ABS plastic substrate is roughened (textured) by etching with e.g., chromic acid. In the catalyst step, a catalyst containing a PdSn complex for depositing electroless nickel plating coating is adsorbed to the surface of the ABS plastic substrate. In the accelerator step, the adsorbed catalyst is activated. In the electroless nickel plating step, electroless nickel plating is performed in an electroless nickel plating solution in the presence of a reducing agent containing sodium hypophosphite to form a nickel coating as a conductive coating on the surface of the ABS plastic substrate.

After conductivity is imparted to the plastic substrate by the preprocessing step, the substrate is subjected to an electrolytic plating step in which e.g., a copper plating step, a semi-bright nickel (SBN) plating step, a bright nickel (BN) plating step, a dull nickel (DN) plating step, and a chromium plating step are sequentially applied. A plurality of metallic coating layers is formed in this way on the nickel coating, with the result that not only various functions but also luster metallic appearance are imparted to car accessories.

In the interval between the steps, a plurality of cleaning steps is carried out as necessary to avoid contamination in the subsequent step with an agent(s) used in each step.

In a car accessory manufactured in this way, if it has a complicated shape and recesses in the surface, the thickness of each metallic coating layer formed by electrolytic plating sometimes fails to be uniform. This is because when a metallic coating is formed by electrolytic plating, current density of the inside of a complicated shape and a recess tends to be low, with the result that the thickness of the metallic coating corresponding to these portions becomes extremely thin. Because of this, the whole metallic coating of the car accessory cannot be uniform, with the result that the external shape is not satisfactory as the car accessory.

In the electroplating method described in Japanese Laid-Open Patent Publication No. 2001-073198, it is disclosed that, in order to form a metallic coating being uniform to the inside of an object, electrolytic plating is carried out by arranging an auxiliary electrode in the inside of the object. Owing to use of the auxiliary electrode, the current density at the inside and a recess of the object can be enhanced, with the result that the metallic coating on the inside of the object having the same thickness as that of the metallic coating on the exterior portion of the object can be formed.

However, it is not preferable to apply such an electroplating method in forming a metallic coating on a non-conductive substrate, because metal ions are deposited also on the auxiliary electrode similarly to the non-conductive substrate to form a conductive layer, in the electroless plating performed prior to the electrolytic plating.

Specifically, referring to FIG. 6A, during the electroless nickel plating, a nickel coating 101 is formed as a conductive coating on an ABS plastic substrate 100 by an oxidation-reduction reaction taking place in an electroless nickel plating solution 300 in which a reducing agent containing sodium hypophosphite is present. If preprocessing is applied to an auxiliary electrode 200, which is arranged to conform to the shape of the ABS plastic substrate 100, simultaneously with the ABS plastic substrate 100, in individual steps prior to the electroless nickel plating, the surface of the auxiliary electrode 200 is modified and a nickel coating 201 as a conductive layer is similarly formed.

As shown in FIG. 6B, in copper plating following the electroless nickel plating, the anode 500 immersed in a copper plating solution 400 and an auxiliary electrode 200 are both connected to the anode of a power supply. Then, electric current is applied between the ABS plastic substrate 100 at the cathode of the power supply and the set of the anode 500 and the auxiliary electrode 200. If the auxiliary electrode 200 is positively charged, the nickel coating 201 on the auxiliary electrode 200 is detached and the detached nickel coating 201 sometimes attaches to the surface of the ABS plastic substrate 100 negatively charged. As a result, a copper plating layer 102 is formed that has a projection 202 ascribed to the detached piece and formed on the nickel coating 101 of the ABS plastic substrate 100. In each of the electrolytic plating, i.e., semi-bright nickel (SBN) plating, bright nickel (BN) plating, dull nickel (DN) plating, and chrome plating, a metallic coating is laminated on the projection 202. Because of this, the surface of the resultant car accessory fails to be smooth and its external shape sometimes deteriorates.

The plating method described in Japanese Laid-Open Patent Publication No. 2004-068107 includes a step for forming a uniform coating from the interior to exterior portions of the object without using an auxiliary electrode. According to the plating method, objects are independently placed in cells and the cells are housed in a support communicating with the exterior portion. The objects in the cells are electroplated by rotating the support in a predetermined direction while preventing the cells from falling.

However, in the plating method described in Japanese Laid-Open Patent Publication No. 2004-068107, a rotating mechanism for rotating the support is required. In addition, a large rotational space for arranging a plurality of objects independently in a plurality of cells is required, with the result that the apparatus is enlarged and complicated.

SUMMARY OF THE INVENTION

Accordingly, it is an objective of the present invention to provide a plating method that provides a plated product having a favorable external shape without using a large apparatus.

In accordance with a first aspect of the present invention, a plating method is provided that includes an electroless plating step for forming a conductive coating on a non-conductive substrate and an electrolytic plating step for forming a metallic coating on the conductive coating by using an auxiliary electrode, which is arranged to conform to the shape of the non-conductive substrate. In the electroless plating step, with the position of the auxiliary electrode adjusted in relation to the non-conductive substrate, the non-conductive substrate and the auxiliary electrode are both immersed in an electroless plating solution to form the conductive coating. In the electrolytic plating step, with the position of the auxiliary electrode adjusted in relation to the non-conductive substrate, the non-conductive substrate and the auxiliary electrode are both immersed in an electrolytic plating solution to form the metallic coating. In the electroless plating step, electric current is applied while using the auxiliary electrode as an anode and a conductive member immersed in the electroless plating solution as a cathode.

If electroless plating is carried out with the position of an auxiliary electrode adjusted in relation to a non-conductive substrate, not only the non-conductive substrate but also the auxiliary electrode is immersed in an electroless plating solution and exposed to metal ions dissolved in the electroless plating solution. In contrast, according to the aforementioned configuration, since electric current is applied while using the conductive member as a cathode and the auxiliary electrode as an anode during the electroless plating, the auxiliary electrode is positively charged and metal ions are restrained from moving closer to the auxiliary electrode, with the result that metal deposition on the auxiliary electrode is limited. Accordingly, a conductive layer is unlikely to be formed on the auxiliary electrode, and an auxiliary electrode having a conductive layer formed thereon is not brought into the electrolytic plating step. In the electrolytic plating step following the electroless plating step, the auxiliary electrode having no conductive layer formed on the surface can be used and thus detachment of the conductive layer during the electrolytic plating is limited. The formation of a projection ascribed to the conductive layer detached from the auxiliary electrode on the surface of the conductive coating on the non-conductive substrate is limited, with the result that a plated product having a favorable external shape is obtained.

In accordance with a second aspect of the present invention, a plating method is provided that includes a preprocessing step for forming a conductive coating on a substrate, an electrolytic plating step for forming a metallic coating on the conductive coating by using an auxiliary electrode, which is arranged to conform to the shape of the substrate, and a cleaning step performed between the preprocessing step and the electrolytic plating step. In the preprocessing step, with the position of the auxiliary electrode adjusted in relation to the substrate, the conductive coating is formed on the substrate. In the cleaning step, with the position of the auxiliary electrode adjusted in relation to the substrate, the substrate and the auxiliary electrode are both immersed in a cleaning liquid. In the electrolytic plating step, while the auxiliary electrode is positioned on the substrate, the substrate and the auxiliary electrode are both immersed in an electrolytic plating solution, and the metallic coating is formed on the conductive coating with the auxiliary electrode used as an anode. In the cleaning step, electric current is applied while using the auxiliary electrode as an anode and a conductive member immersed in the cleaning liquid as a cathode.

In the preprocessing step, since a conductive coating is formed on the substrate with the position of an auxiliary electrode adjusted in relation to the substrate, the conductive coating is formed not only on the substrate and the conductive layer is also formed on the auxiliary electrode in some cases. The auxiliary electrode having a conductive layer formed on the surface is used in the electrolytic plating step, the conductive layer is detached during the electrolytic plating, and the detached conductive layer is sometimes adhered to the surface of an object negatively charged to form a projection. In this respect, according to the aforementioned configuration, since electric current is applied while using the auxiliary electrode as an anode and the conductive member immersed in the cleaning liquid as a cathode in the cleaning step, the conductive layer formed on the auxiliary electrode can be detached. With this configuration, the auxiliary electrode having a conductive layer formed thereon is restrained from being brought into the electrolytic plating step. In the electrolytic plating step, the auxiliary electrode having no conductive layer formed on the surface can be used and detachment of the conductive layer during the electrolytic plating is limited. The formation of a projection ascribed to the conductive layer detached from the auxiliary electrode on the surface of the conductive coating of the substrate is limited, with the result that a plated product having a favorable external shape is obtained.

BRIEF DESCRIPTION OF THE DRAWINGS

FIG. 1A shows the state before the electroless plating, and FIG. 1B shows the state during the non-electrolytic plating.

FIG. 3A shows the state during the electroless plating, FIG. 3B shows the state before the cleaning treatment following the electroless plating step, and FIG. 3C shows the state of the cleaning treatment following the electroless plating step.

FIG. 7A shows the case where an aqueous sodium hydroxide solution was used as a cleaning liquid, and FIG. 7B shows the case where sulfuric acid was used as a cleaning liquid.

FIG. 8A shows the case where a 0.1 mol/L aqueous sodium hydroxide solution was used as a cleaning liquid, and FIG. 8B shows the case where a 0.1 mol/L sulfuric acid was used as a cleaning liquid.

DETAILED DESCRIPTION OF THE PREFERRED EMBODIMENTS

First Embodiment

A plating method according to a first embodiment of the present invention will now be described, referring to a plating method known in the art, which has an electroless plating step for forming a conductive coating on a non-conductive substrate made of an ABS plastic to impart conductivity and a plurality of electrolytic plating steps for laminating metallic coatings different in function on the conductive coating.

Since the electroless plating step is a characteristic feature in this embodiment, the electroless plating step will be principally described by way of an electroless nickel plating step. The type of electroless plating and the material of a substrate are not limited to those described herein and may be changed as necessary.

Figure 1A:
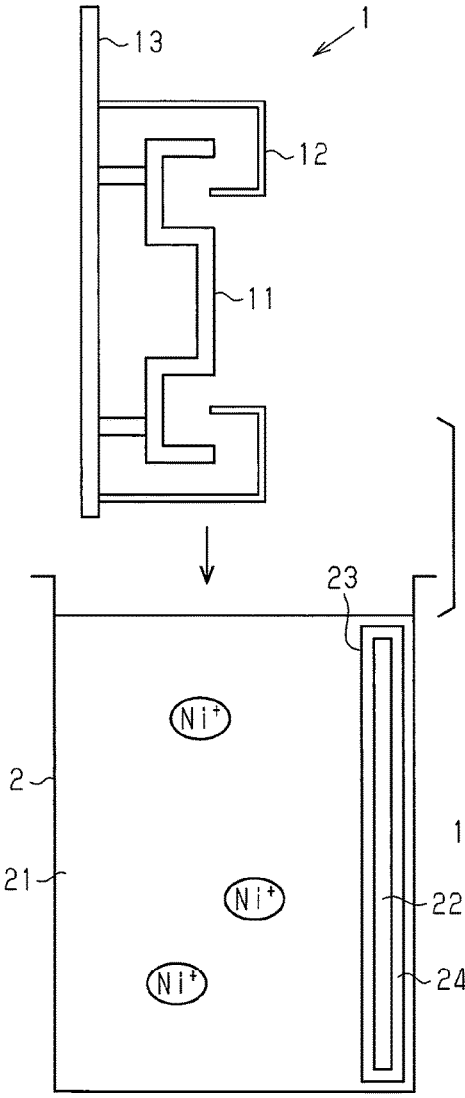
FIGS. 1A and 1B are explanatory diagrams showing an electroless plating step according to a first embodiment, where

As shown in FIG. 1A, a non-conductive substrate 11 made of an ABS plastic has a surface on which irregularities and recesses are present. The non-conductive substrate 11 and an auxiliary electrode 12 are both connected to a jig 13 and integrated into an integrated object 1. In the electrolytic plating step following the electroless nickel plating step, the auxiliary electrode 12 is connected in such a manner that its position is adjusted to correspond to a depression and a recess of the non-conductive substrate 11 in order to ensure current density within the non-conductive substrate 11. The auxiliary electrode 12 herein is not particularly limited in material. However, an insoluble electrode made of, e.g., titanium and platinum, is preferably used.

The non-conductive substrate 11 and the auxiliary electrode 12 are subjected to a preprocessing step including an electroless nickel plating step for imparting conductivity to the non-conductive substrate 11 and thereafter subjected to an electrolytic plating step. The preprocessing step includes steps known in the art, which are a degreasing step for degreasing an ABS plastic substrate to remove fats and oils adhered to the surface of the ABS plastic substrate, an etching step for etching the ABS plastic substrate with e.g., chromic acid to roughen (texture) the surface thereof, a catalyst step for adsorbing a catalyst, which contains a PdSn complex for depositing electroless nickel plating coating, to the surface of the ABS plastic substrate, an accelerator step for activating the catalyst adsorbed, and an electroless nickel plating step. Between steps included in the preprocessing step and the electrolytic plating step, if necessary, a plurality of cleaning steps is provided. In all the steps, the integrated object 1, in which the non-conductive substrate 11, auxiliary electrode 12 and jig 13 are integrally connected, is transferred in a cluster.

As shown in FIG. 1A, an electroless nickel plating bath 2 is filled with an electroless nickel plating solution 21. As the electroless nickel plating solution 21, an electroless nickel plating solution having a composition known in the art can be used. To the sidewall of the electroless nickel plating bath 2, a metal electrolytic plate 22 is fixed in advance. The metal electrolytic plate 22, although it is provided at a single site in FIG. 1A, may be provided at a plurality of sites and the sites are not particularly limited. The metal electrolytic plate 22 is coated with an ion-exchange membrane 23, and the inside of the ion-exchange membrane 23 is filled with an electrolyte 24 containing no metal ions.

As the metal electrolytic plate 22, a metal plate known in the art and used as an insoluble electrode can be used. As the material of the metal plate, for example, stainless steel and a platinum-iridium alloy are mentioned.

Since the ion-exchange membrane 23 is provided in order to limit adhesion of nickel ions in the electroless nickel plating solution 21 to the metal electrolytic plate 22, a membrane having a pore size which is too small to pass metal ions (nickel ion in this embodiment) is selected. As the ion-exchange membrane 23, an ion-exchange membrane known in the art, such as a cation exchange membrane and an anion exchange membrane, can be used. For example, a cation exchange membrane made of a material, i.e., Nafion (registered trade mark), which is a copolymer of a fluorine resin based on sulfonated tetrafluoroethylene, can be preferably mentioned.

As the electrolyte 24, which fills the inside of the ion-exchange membrane 23, an electrolyte known in the art can be used. An acidic electrolyte or an alkaline electrolyte may be used. The electrolyte 24 can be selected depending upon the acidity or alkalinity of the electroless nickel plating solution 21. More specifically, if the electroless nickel plating solution 21 is acidic, an acidic electrolyte such as sulfuric acid is used. If the electroless nickel plating solution 21 is alkaline, an alkaline electrolyte such as ammonia water may be selected. An electrolyte having the same composition as that of the electroless nickel plating solution 21 and containing no nickel ions, may be used as the electrolyte 24.

Figure 1B:
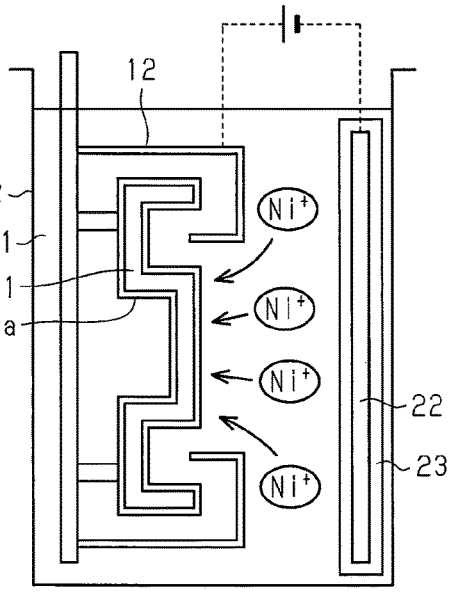

As shown in FIG. 1B, after being processed in the degreasing step, the etching step, the catalyst step and the accelerator step, the integrated object 1 is put in the electroless nickel plating bath 2 filled with the electroless nickel plating solution 21 and subjected to electroless nickel plating. As the result of the electroless nickel plating, a conductive coating 11*a* is formed on the non-conductive substrate 11 to impart conductivity to the non-conductive substrate 11 made of a plastic.

In this embodiment, during the electroless nickel plating, electric current is applied while using the auxiliary electrode 12 as an anode and the metal electrolytic plate 22 immersed in the electroless nickel plating solution 21 as a cathode. Since the auxiliary electrode 12 is positively charged by the current supply, nickel ions present in the electroless nickel plating solution 21 act electrically repulsive, with the result that deposition of metallic nickel on the auxiliary electrode 12 is limited.

Current supply to the auxiliary electrode 12 is preferably continued all the time during which the integrated object 1 is immersed in the electroless nickel plating solution 21. The magnitude of the applied voltage is determined so that deposition of metallic nickel to the auxiliary electrode 12 is prevented and in accordance with the composition of electroless nickel plating solution 21, the material of the auxiliary electrode 12 and the composition of the electrolyte 24.

After being processed in the electroless nickel plating step, the integrated object 1 is subjected to a single or a plurality of cleaning steps in order to rinse away the electroless nickel plating solution 21 adhered to the surface and thereafter subjected to electrolytic plating. The electrolytic plating step and cleaning step can be carried out in accordance with the methods known in the art. The electrolytic plating step can be appropriately selected depending upon the characteristics and function of the metallic coating to be applied.

Operation of the plating method according to the present embodiment will now be described.

After being processed in a series of steps, i.e., a degreasing step, an etching step, a catalyst step, and an accelerator step, the non-conductive substrate 11 is subjected to electroless nickel plating. Accordingly, the surface of the non-conductive substrate 11 is roughened and the catalyst adsorbed to the surface is activated, with the result that metallic nickel is readily deposited on the surface in the electroless nickel plating step. To the surface of the non-conductive substrate 11 immersed in the electroless nickel plating solution 21, the nickel ions dissolved in the electroless nickel plating solution 21 are adsorbed and deposited as metallic nickel. In this manner, the conductive coating 11*a*, which imparts conductivity to the non-conductive substrate 11, is formed on the non-conductive substrate 11.

Also the auxiliary electrode 12, which is connected to the jig 13 together with the non-conductive substrate 11 and serves as the integrated object 1, is subjected to a series of preprocessing steps, i.e., a degreasing step, an etching step, a catalyst step, an accelerator step, and electroless nickel plating. Accordingly, the surface of the auxiliary electrode 12, which is treated simultaneously with the non-conductive substrate 11, as the integrated object 1, is modified.

However, the auxiliary electrode 12, which is immersed in the electroless nickel plating solution 21 and connected in an anode, is positively charged. Even if the auxiliary electrode 12 has a surface profile that allows metallic nickel to easily deposit, nickel ions act electrically repulsive and cannot move closer to the surface. Because of this, deposition of metallic nickel to the surface of the auxiliary electrode 12 is limited and formation of a conductive layer is limited.

Figure 2:
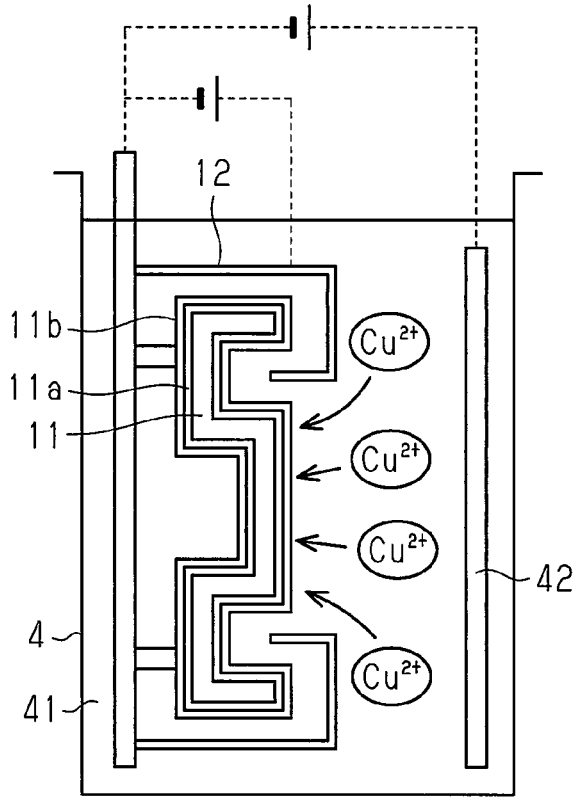
FIG. 2 is an explanatory diagram showing an electrolytic plating step following the electroless plating step.

Referring to FIG. 2, the electrolytic plating step performed after the electroless nickel plating step will be described. If electrolytic plating, for example, copper plating, is carried out, the integrated object 1 is immersed in a copper plating bath 4 filled with a copper plating solution 41. Subsequently, a copper plate 42 and the auxiliary electrode 12 arranged in the copper plating solution 41 are connected to an anode, and the non-conductive substrate 11 is connected to a cathode via the conductive coating 11*a*. In this state, electric current is applied. In this manner, copper is deposited onto the conductive coating 11*a* of the non-conductive substrate 11 to form a metallic coating (copper coating) 11*b*.

In the auxiliary electrode 12 of this embodiment, metallic nickel is not deposited on the surface thereof in the electroless nickel plating step, and no conductive layer is formed. Because of this, metallic nickel is not detached from the positively charged auxiliary electrode 12. As a result, in the copper plating step, formation of a projection ascribed to detached metallic nickel on the conductive coating 11*a* of the non-conductive substrate 11 negatively charged, is limited. On the conductive coating 11*a* of the non-conductive substrate 11, a smooth copper coating 11*b* is formed.

The plating method of the present embodiment achieves the following advantages.

(1) In the electroless nickel plating step, the conductive coating 11*a* is formed on the non-conductive substrate 11. On the positively charged auxiliary electrode 12, no conductive layer is formed because deposition of metallic nickel is limited. The metallic nickel can be selectively deposited only on the non-conductive substrate 11. In addition, since the auxiliary electrode 12 has no conductive coating formed thereon, the auxiliary electrode 12 having metallic nickel deposited thereon is not brought into the following electrolytic plating step. Accordingly, in the electrolytic plating step following the electroless nickel plating step, even if the auxiliary electrode 12 is connected to an anode and the non-conductive substrate 11 is connected to a cathode to apply electric current, detachment of metallic nickel from the auxiliary electrode 12 is avoided. Formation of a projection ascribed to attachment of detached pieces on the conductive coating 11*a* of the non-conductive substrate 11, is limited.

(2) The metal electrolytic plate 22 and the ion-exchange membrane 23 are both arranged in the electroless nickel plating bath 2 used in a plating method conventionally employed and electric current is applied between the auxiliary electrode 12 and the metal electrolytic plate 22 immersed in the electroless nickel plating solution 21. In this manner, deposition of metallic nickel is efficiently limited. Exterior parts for vehicles having excellent external shape are easily obtained without greatly modifying conventional equipment. This is favorable in view of costs.

(3) Since the non-conductive substrate 11 and the auxiliary electrode 12 are integrally connected to the jig 13 into the integrated object 1, it is easy to transfer the non-conductive substrate 11 and the auxiliary electrode 12 from step to step. If the non-conductive substrate 11 and the auxiliary electrode 12 are integrated with the jig 13 to prepare the integrated object 1 in the beginning of the series of steps, it is not necessary to adjust the position of the auxiliary electrode 12 in relation to the non-conductive substrate 11 in each of the following steps. Because of this, the workability is improved.

Second Embodiment

A plating method according to a second embodiment of the present invention will now be described, referring to a plating method known in the art, which has an electroless plating step for forming a conductive coating on a non-conductive substrate made of an ABS plastic to impart conductivity and a plurality of electrolytic plating steps for laminating metallic coatings different in function. Since the cleaning step performed after the electroless plating step is a characteristic feature in this embodiment, an electroless nickel plating step used as an example of the electroless plating step and the cleaning step following the electroless nickel plating step will be principally described. Like reference numerals are used to designate like members corresponding to those like the first embodiment. The type of electroless plating and the material of the substrate are not limited to those described herein and may be changed as necessary.

Figure 3A:
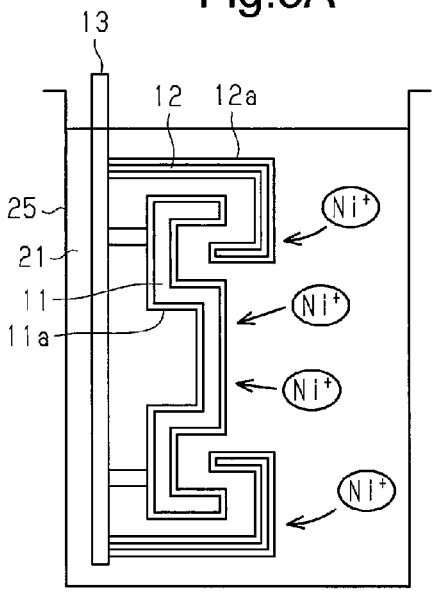
FIGS. 3A to 3C are explanatory diagrams showing an electroless plating step and a cleaning step following the electroless plating step, where

As shown in FIG. 3A, the non-conductive substrate 11 made of an ABS plastic has irregularities and recesses in the surface. The non-conductive substrate 11 and the auxiliary electrode 12 are both connected to the jig 13 and integrated into an integrated object 1. The auxiliary electrode 12 is connected in such a manner that its position is adjusted to correspond to a depression and a recess of the non-conductive substrate 11 in order to ensure current density within the non-conductive substrate 11. The auxiliary electrode 12 herein is not particularly limited in material. However, an insoluble electrode made of, e.g., titanium and platinum, is preferably used.

The non-conductive substrate 11 and the auxiliary electrode 12 are subjected to a preprocessing step including an electroless nickel plating step for imparting conductivity to the non-conductive substrate 11, a single or a plurality of cleaning steps after the preprocessing step, and the following electrolytic plating step. The preprocessing step includes steps known in the art, including a degreasing step, an etching step, a catalyst step, an accelerator step and an electroless nickel plating step. Between individual steps included in the preprocessing step and the electrolytic plating step, if necessary, a single or a plurality of cleaning steps may be provided other than the single or a plurality of cleaning steps carried out after the preprocessing step. In all the steps, the integrated object 1, in which the non-conductive substrate 11, the auxiliary electrode 12, and the jig 13 are connected and integrated, is transferred in a cluster.

As shown in FIG. 3A, an electroless nickel plating bath 25 is filled with the electroless nickel plating solution 21. In this embodiment, unlike the first embodiment, neither a metal electrolytic plate nor an ion-exchange membrane is present in the electroless nickel plating bath 25. As the electroless nickel plating bath 25, a bath having a structure known in the art can be used. As the electroless nickel plating solution 21, a plating solution having a composition known in the art can be used.

After being processed in a series of steps, i.e., a degreasing step, an etching step, a catalyst step and an accelerator step, the integrated object 1 is put in the electroless nickel plating bath 25 filled with the electroless nickel plating solution 21, and subjected to electroless nickel plating. Owing to the series of steps, the surface of the non-conductive substrate 11 is roughened and the catalyst adsorbed to the surface is activated. Also, the surface of the auxiliary electrode 12 is modified. As a result of the electroless nickel plating, metallic nickel is deposited on the non-conductive substrate 11 to form the conductive coating 11*a*. In addition, metallic nickel is also deposited on the auxiliary electrode 12 to form a conductive layer 12*a*.

Figure 3B:
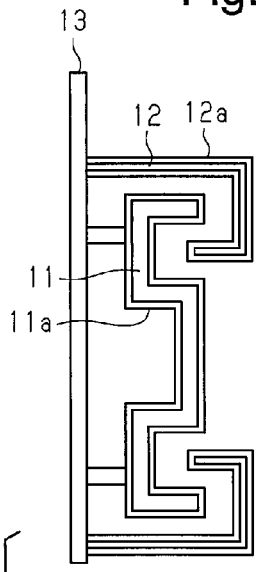

As shown in FIG. 3B, the integrated object 1, to which the electroless nickel plating is applied, is put in a cleaning bath 3 filled with a cleaning liquid 31 in order to rinse away the electroless nickel plating solution 21 adhered to the surface. As the cleaning liquid 31 of this embodiment, an electrolyte having an electrolytic component dissolved therein is used. As the electrolytic component contained in the cleaning liquid 31, an electrolytic component known in the art can be selected. Examples thereof include sodium hydroxide, sodium chloride, sulfuric acid, potassium sulfate. The concentration of the electrolytic component in the cleaning liquid 31, which can be set appropriately, is, for example, preferably 0.1 mol/L or more in the case of an aqueous sodium hydroxide solution and 0.05 mol/L or more in the case of sulfuric acid.

To the sidewall of the cleaning bath 3, a metal electrolytic plate 32 is fixed in advance. The material of the metal electrolytic plate 32 to be arranged in the cleaning bath 3 is not particularly limited, and a metal plate known in the art can be used. Examples thereof include stainless steel and a platinum-iridium alloy. Although the metal electrolytic plate 32 is provided at a single site in FIG. 3B, it may be provided at a plurality of sites and the sites are not particularly limited.

Figure 3C:
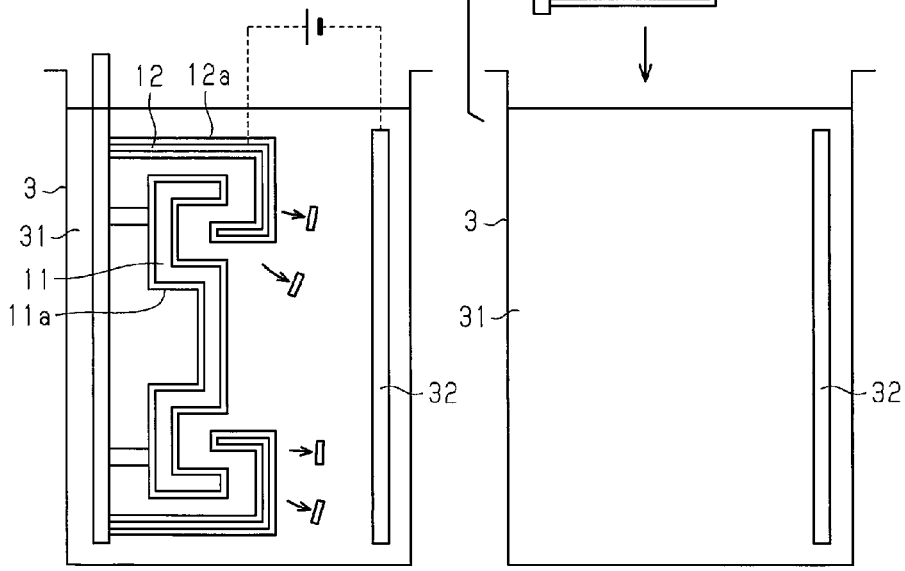

As shown in FIG. 3C, in the cleaning step following the electroless nickel plating step, the integrated object 1 is put in the cleaning bath 3 filled with a cleaning liquid 31 and electric current is applied while using the auxiliary electrode 12 as an anode and the metal electrolytic plate 32 as a cathode. Since the auxiliary electrode 12 is positively charged, metallic nickel deposited on the auxiliary electrode 12 by the electroless nickel plating is detached from the auxiliary electrode 12 and suspended in the cleaning liquid 31.

Current supply is preferably continued all the time during which the integrated object 1 is immersed in the cleaning liquid 31. Owing to continuous current supply, substantially the whole metallic nickel deposited is detached from the auxiliary electrode 12 and conductive layer 12*a* formed on the auxiliary electrode 12 substantially disappears. The magnitude of the applied voltage determined so that metallic nickel can be detached from the auxiliary electrode 12 and in accordance with the material of the auxiliary electrode 12 and the composition of the cleaning liquid 31.

In this manner, in the cleaning step following the electroless nickel plating step of this embodiment, detachment of the electroless nickel plating solution 21 adhered to the integrated object 1 by cleaning and detachment of the conductive layer 12*a* formed on the auxiliary electrode 12 are simultaneously carried out. In the cleaning step following the electroless nickel plating step, it is preferable that, subsequently to the cleaning step by which the conductive layer 12*a* attached to the auxiliary electrode 12 is also detached, a cleaning step for rinsing away the cleaning liquid 31 adhered to the integrated object 1 be further additionally provided.

After being processed in a plurality of cleaning steps, the integrated object 1 is subjected to an electrolytic plating step. The electrolytic plating step can be appropriately selected depending upon the characteristics and function of the metallic coating to be applied and can be carried out by a method known in the art.

Operation of the plating method according to the present embodiment will now be described.

The non-conductive substrate 11 and the auxiliary electrode 12 are connected to the jig 13, integrated into one body and subjected to a series of steps. i.e., a degreasing step, an etching step, a catalyst step, and an accelerator step, and then electroless nickel plating is applied. Accordingly, the surface of the non-conductive substrate 11 is roughened and the catalyst adsorbed to the surface is activated, with the result that the surface profile, which allows metallic nickel to easily deposit in the electroless nickel plating step, is formed. The surface of the auxiliary electrode 12, which is surface-treated simultaneously with the non-conductive substrate 11, is also modified. Because of this, to the surfaces of the non-conductive substrate 11 and the auxiliary electrode 12 immersed in the electroless nickel plating solution 21, the nickel ions dissolved in the electroless nickel plating solution 21 are adsorbed and deposited as metallic nickel. In this manner, a conductive coating 11*a*, which imparts conductivity to the non-conductive substrate 11, is formed on the non-conductive substrate 11. At the same time, a conductive layer 12*a* is formed on the auxiliary electrode 12.

In the cleaning step following the electroless nickel plating step, the auxiliary electrode 12 having the conductive layer 12*a* formed thereon is connected to an anode, and electric current is applied while using the metal electrolytic plate 32 as a cathode. Since the auxiliary electrode 12 is positively charged by the current supply and metallic nickel deposited on the surface of the auxiliary electrode 12 is detached. The conductive layer 12*a* substantially disappears by continuous supply of electric current to the auxiliary electrode 12.

As shown in FIG. 2, after being processed in the cleaning step following the electroless nickel plating step, the integrated object 1, in which the conductive layer 12*a* on the auxiliary electrode 12 substantially disappears, is subjected to an electrolytic plating step. If electrolytic plating, for example, copper plating, is carried out, the integrated object 1 is immersed in a copper plating bath 4 filled with a copper plating solution 41. Subsequently, the copper plate 42 and the auxiliary electrode 12 arranged in the copper plating solution 41 are connected to an anode, and electric current is applied while connecting the non-conductive substrate 11 to a cathode. As a result, on the conductive coating 11*a* of the non-conductive substrate 11, copper is deposited to form a metallic coating (copper coating) 11*b*. From the auxiliary electrode 12 of this embodiment, the conductive layer 12*a* substantially disappears by passing it through the cleaning step performed in the cleaning bath 3, with the result that detachment of metallic nickel from the positively charged auxiliary electrode 12 does not take place. Because of this, in the copper plating step, formation of a projection ascribed to detached metallic nickel on the conductive coating 11*a* of the non-conductive substrate 11 negatively charged is limited. On the conductive coating 11*a* of the non-conductive substrate 11, a smooth copper coating 11*b* is formed.

In addition to the item (2) of the first embodiment, the second embodiment achieves the following advantages.

(4) Since the non-conductive substrate 11 and the auxiliary electrode 12 are integrated, subjected to a series of preprocessing steps, i.e., a degreasing step, an etching step, a catalyst step, an accelerator step and an electroless nickel plating step, the conductive coating 11*a* is formed on the non-conductive substrate 11, whereas the conductive layer 12*a* is formed on the auxiliary electrode 12. However, in the cleaning step performed after the electroless nickel plating step, since the auxiliary electrode 12 immersed in the cleaning liquid 31 is positively charged, metallic nickel adhered to the auxiliary electrode 12 is detached, with the result that the conductive layer 12*a* substantially disappears. In this manner, the state where the conductive coating 11*a* is selectively formed only on the non-conductive substrate 11, and the auxiliary electrode 12 on which metallic nickel is deposited is not brought into the electrolytic plating step. Thus, in the electrolytic plating step following this step, even if the auxiliary electrode 12 is connected to an anode and electric current is applied while connecting the non-conductive substrate 11 to a cathode, detachment of metallic nickel from the auxiliary electrode 12 is avoided and formation of a projection ascribed to detached pieces on the conductive coating 11*a* of the non-conductive substrate 11 is limited.

(5) The metal electrolytic plate 32 is arranged in the cleaning bath 3, which is used in a plating method known in the art, and electric current is applied between the auxiliary electrode 12 and the metal electrolytic plate 32 immersed in the cleaning liquid 31. In this manner, metallic nickel is efficiently detached. Exterior parts for vehicles excellent in external shape can be easily obtained without greatly modifying conventional equipment. This is favorable in view of costs.

The above illustrated embodiments may be modified as follows. The following modifications may be combined as necessary.

In each of the above illustrated electroless nickel plating is described as an example of electroless plating. However, electroless copper plating or other electroless plating may be used.

In the second embodiment, the electroless nickel plating step is described as an example, in order to impart conductivity to the non-conductive substrate 11. However, it is not limited that conductivity is imparted by the electroless plating. Conductivity may be imparted to the non-conductive substrate 11 by sputtering or metal deposition. In this case, not the non-conductive substrate 11 but a conductive substrate such as a metal may be used.

The first embodiment and the second embodiment may be combined. In short, the invention may be configured as follows. In the electroless nickel plating step, the metal electrolytic plate 22 and the ion-exchange membrane 23 are both arranged in the electroless nickel plating bath 2 and electric current is applied. In the cleaning step, the metal electrolytic plate 32 is arranged in the cleaning bath 3 and electric current is applied. With this configuration, the conductive layer 12*a* is further effectively restrained from being brought into the electrolytic plating step.

In the first embodiment, a cleaning step known in the art can be carried out. In particular, also in the cleaning step following the electroless nickel plating step, the cleaning step known in the art can be carried out. The integrated object 1 does not necessarily need to be cleaned by immersing it in the cleaning liquid 31 in the cleaning bath 3, but may be cleaned, for example, by spraying water onto the surface thereof.

EXAMPLES

Experiment 1

Experiment 1 corresponds to the first embodiment.

Figure 4:
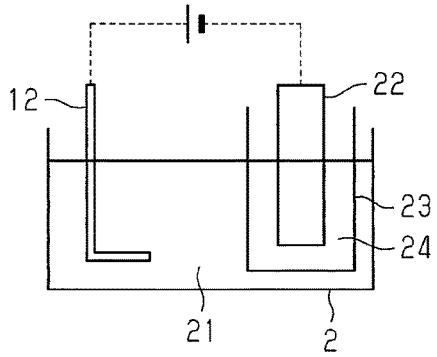
FIG. 4 is an explanatory diagram of Experiment 1.
Figure 5:
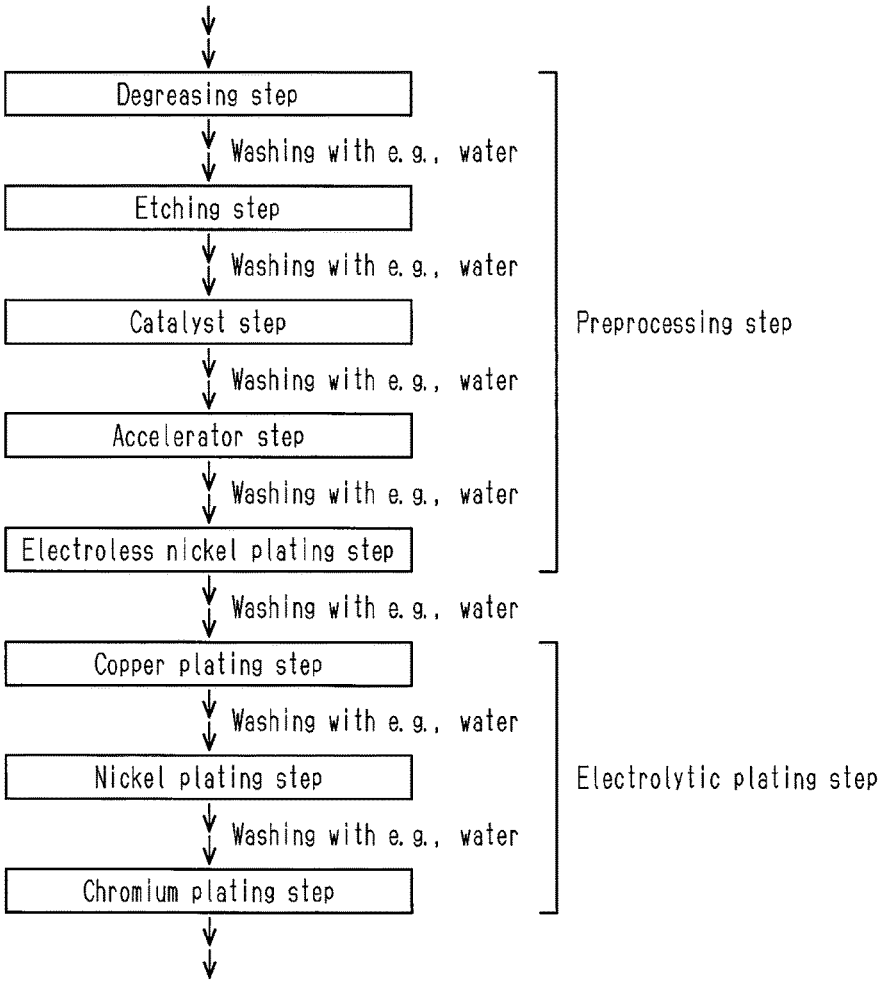
Fig.5(Prior Art)
FIG. 5 is an explanatory diagram showing a step for forming a metallic coating on a plastic substrate.
Figure 6A:
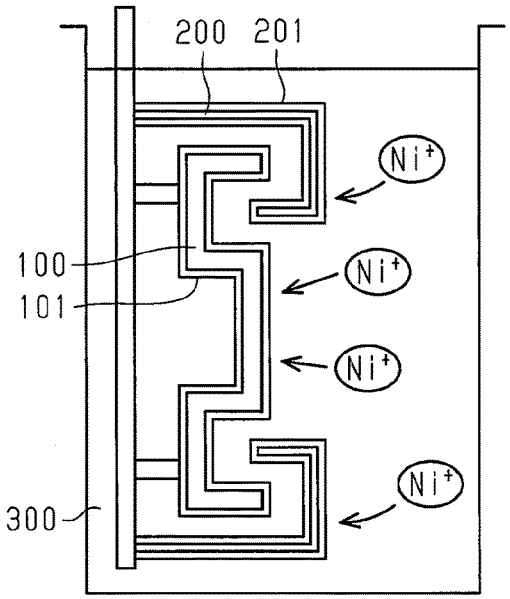
Fig.6A(Prior Art)
FIGS. 6A and 6B are explanatory diagrams showing conventional electroplating steps.
Figure 6B:
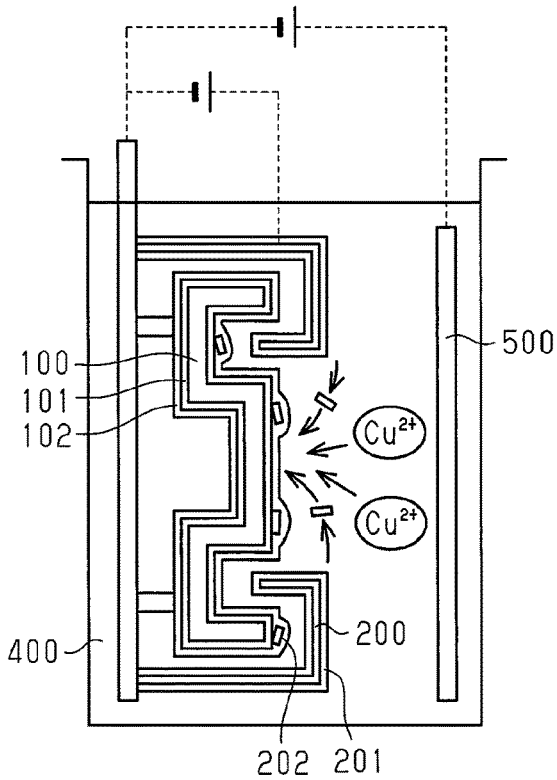
Fig.6B(Prior Art)

As shown in FIG. 4, while the metal electrolytic plate 22 was surrounded by the ion-exchange membrane 23 filled with the electrolyte 24 containing no metal ions, a metal electrolytic plate 22 made of SUS material was immersed in the electroless nickel plating bath 2 filled with the electroless nickel plating solution 21. Subsequently, the auxiliary electrode 12 made of Ti—Pt was immersed in the electroless nickel plating solution 21. Using the metal electrolytic plate 22 as a cathode and the auxiliary electrode 12 as an anode, electric current was applied.

Influence of Current-Supply Time on Deposition of Metallic Nickel

In Experiment 1, whether metallic nickel was deposited on the auxiliary electrode 12 was checked by using Nafion 117 (thickness: 183 μm) and Nafion 324 (thickness: 152 μm), manufactured by Du Pont Kabushiki Kaisha as the ion-exchange membrane 23, while varying current-supply time and non-current-supply time. Two ion exchange membranes 23 were the same in composition, but different in thickness. In Experiment-Example 1, current-supply time was set to be 60 seconds, and the non-current-supply time was set to be 180 seconds. In Experiment-Example 2, the current-supply time was set to be 150 seconds, and the non-current-supply time was set to be 90 seconds. In Experiment-Example 3, the current-supply time was set to be 240 seconds, and the non-current-supply time was set to be 0.

As the electroless nickel plating solution 21, an alkaline electroless nickel plating solution (trade name "chemical nickel") manufactured by OKUNO CHEMICAL INDUSTRIES CO. LTD., was used. Solution A containing nickel sulfate hexahydrate and Solution B containing sodium hypophosphite serving as a reducing agent and ammonia water serving as a pH adjuster, of "chemical nickel" (trade name) were blended to adjust an alkaline plating solution to prepare the electroless nickel plating solution 21. Solution A and Solution B were each adjusted so as to have a concentration of 160 mL/L. As the electrolyte 24 within the ion-exchange membrane 23, 10% sulfuric acid was used.

The results of experiments are shown in Table 1. In the table, ○ represents absence of metallic nickel deposition, Δ represents presence of partial deposition, and x represents presence of deposition.

TABLE 1

| Investigation on current-supply time | | | | | | | | |
|---|---|---|---|---|---|---|---|---|
| | Current-supply time | Non-current-supply time | Nafion 117 Voltage (V) | | | Nafion 324 Voltage (V) | | |
| | (seconds) | (seconds) | 0.60 | 0.75 | 0.90 | 0.60 | 2.00 | 5.00 |
| Experiment-Example 1 | 60 | 180 | x | x | x | — | — | Δ |
| Experiment-Example 2 | 150 | 90 | x | x | x | — | — | — |
| Experiment-Example 3 | 240 | 0 | ○ | ○ | ○ | ○ | ○ | — |

From these results, it was found that deposition of metallic nickel was limited in both cases where Nafion 117 and Nafion 324 were used by supplying electric current all the time.

Influence of Electrolyte and Application Voltage

In Experiment 2, investigation was made on electrolyte 24 and applied voltage. As the electroless nickel plating solution 21, the same electroless nickel plating solution 21 used in Experiment 1 was used. As the electrolyte 24, three types of electrolytes: 10% sulfuric acid, 2.5% ammonia water and Solution B (hereinafter referred to as Solution B (160 mL/L chemical nickel)) of an alkaline electroless nickel plating solution (trade name "chemical nickel") manufactured by OKUNO CHEMICAL INDUSTRIES CO. LTD., were used. As the ion-exchange membrane, Nafion 117 was used. Whether metallic nickel is deposited on the auxiliary electrode 12 was checked with respect to three types of electrolytes 24 while varying an application voltage within the range of 0.5 to 1.5 V. In the table, ○ represents absence of metallic nickel deposition, Δ represents presence of partial deposition, and x represents presence of deposition.

TABLE 2

| Investigation on electrolyte and application voltage | | | | | | | | | | | |
|---|---|---|---|---|---|---|---|---|---|---|---|
| | Voltage (V) | | | | | | | | | | |
| Electrolyte | 0.5 | 0.6 | 0.7 | 0.8 | 0.9 | 1.0 | 1.1 | 1.2 | 1.3 | 1.4 | 1.5 |
| 10% sulfuric acid | x | ○ | ○ | ○ | ○ | ○ | ○ | ○ | ○ | ○ | ○ |
| Solution B (160 mL/L chemical nickel) | x | x | ○ | ○ | ○ | ○ | ○ | ○ | ○ | ○ | ○ |
| 2.5% ammonia water | x | x | x | x | x | ○ | ○ | ○ | ○ | ○ | ○ |

From these results, it was found that deposition of metallic nickel was limited by application of a voltage of 0.6 to 1.5V when 10% sulfuric acid was used as the electrolyte 24, by application of a voltage of 0.7 to 1.5 V when Solution B (160 mL/L chemical nickel) was used, and by application of a voltage of 1.0 to 1.7 V when 2.5% ammonia water was used.

Experiment 3

Experiment 3 corresponds to the second embodiment.

Influence of Cleaning Liquid

Figure 7A:
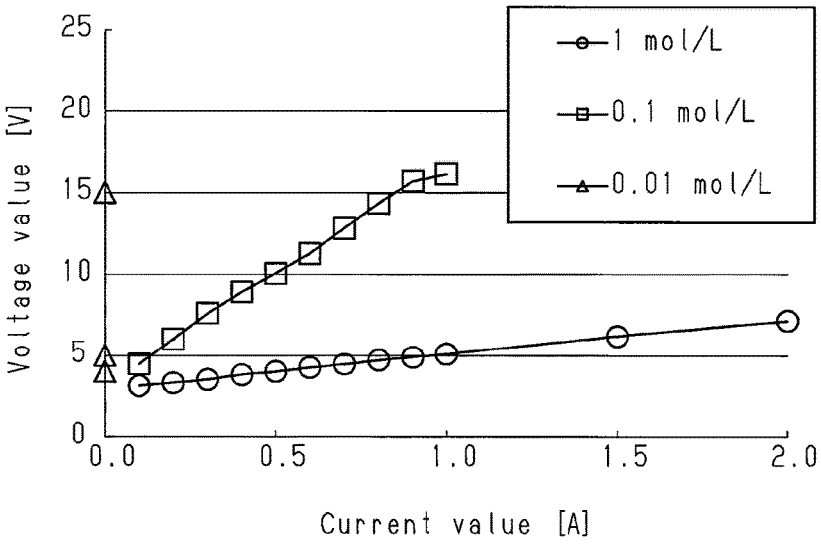
FIGS. 7A and 7B are graphs showing the investigation results on the cleaning liquid of Experiment 2, where
Figure 7B:
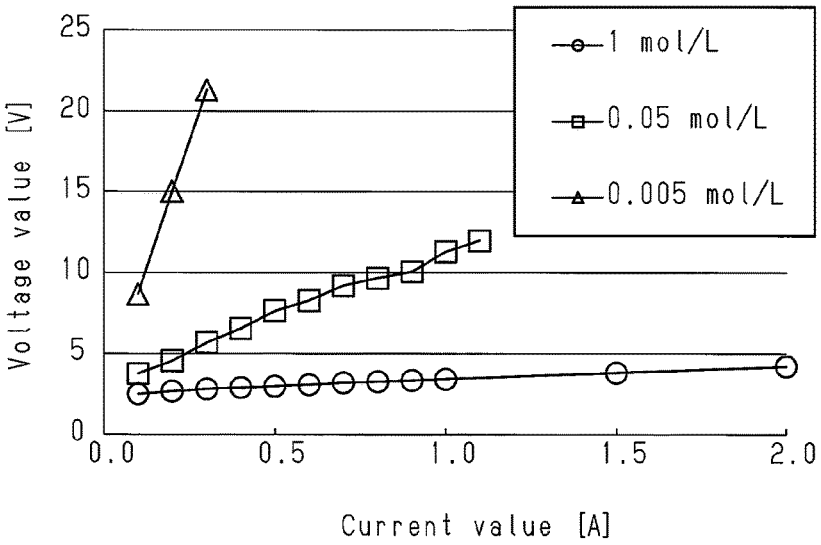

First, in Experiment 3, investigation was made on how to select a cleaning liquid 31 to be used in the cleaning step following the electroless nickel plating step. A metal electrolytic plate 32 made of SUS material was immersed in the cleaning bath 3 filled with a cleaning liquid 31. The auxiliary electrode 12 was connected to an anode and the metal electrolytic plate 32 was connected to a cathode, and electric current was applied. In this way, the lower limit value of a preferable electrolyte concentration as the cleaning liquid 31 was determined based on the electrical conductivity of the auxiliary electrode 12. As the cleaning liquid 31, two types of solutions: an aqueous sodium hydroxide solution and sulfuric acid, were selected. The voltage value was measured while varying the electric current value at each concentration. In this case, selection was made based on a voltage value of 15 V or less at an electric current value of 1.0 A. The results are shown in FIGS. 7A and 7B. FIG. 7A shows the case where an aqueous sodium hydroxide solution was used as the cleaning liquid 31, whereas FIG. 7B shows the case where sulfuric acid was used as the cleaning liquid 31.

From these results, it was found that favorable electrical conductivity between the auxiliary electrode 12 and the metal electrolytic plate 32 was ensured by setting the concentration thereof is set to be 0.1 mol/L or more when an aqueous sodium hydroxide solution was used as the cleaning liquid 31, and by setting the concentration thereof to be 0.05 mol/L or more when the sulfuric acid was used.

Investigation on Detachability

Figure 8A:
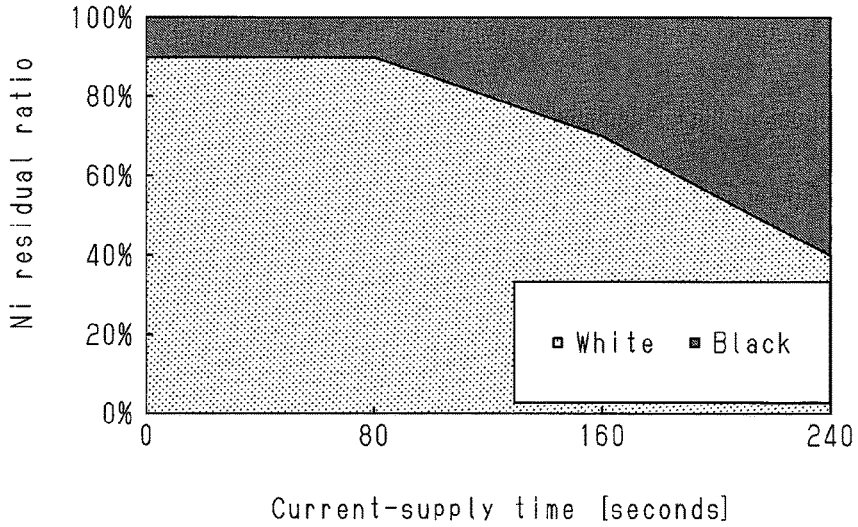
FIGS. 8A and 8B are graphs showing the investigation results on detachability of metallic nickel on the surface of an auxiliary electrode in Experiment 3, where
Figure 8B:
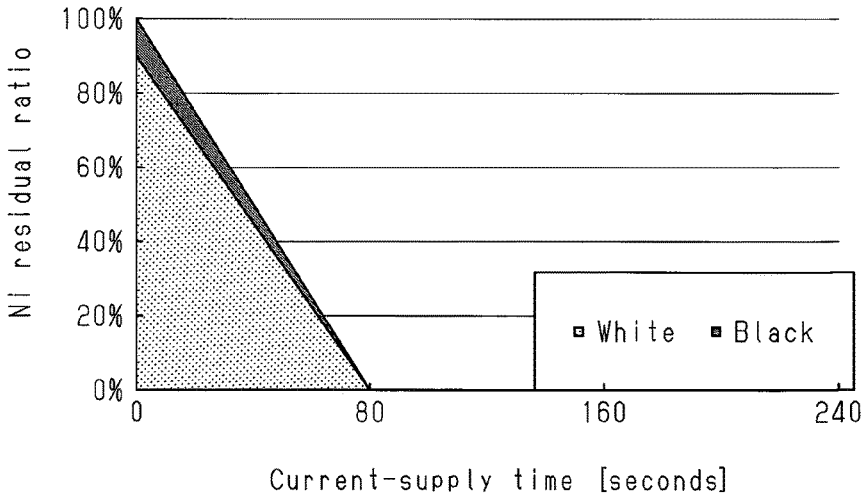

In Experiment 3, investigation was made on detachability of the metallic nickel deposited onto the auxiliary electrode 12. The auxiliary electrode 12 having metallic nickel deposited thereon and the metal electrolytic plate 32 made of SUS material were immersed in the cleaning liquid 31 and an electric current was applied. The state of the metallic nickel on the surface of the auxiliary electrode 12 was observed by varying current-supply time. As the cleaning liquid 31, a 0.1 mol/L aqueous sodium hydroxide solution and a 0.1 mol/L sulfuric acid were used, respectively. Electric current was continuously applied for the current-supply time within the range of 0 to 240 seconds. The results are shown in FIGS. 8A and 8B. The color of the auxiliary electrode 12 to be observed showed the state of metallic nickel adhered. FIG. 8A shows the case where a 0.1 mol/L aqueous sodium hydroxide solution was used as the cleaning liquid 31, whereas FIG. 8B shows the case where a 0.1 mol/L sulfuric acid was used as the cleaning liquid 31.

From these results, in the case of a 0.1 mol/L aqueous sodium hydroxide solution, even if an electric current was applied for 240 seconds, metallic nickel formed on the auxiliary electrode 12 was not detached, whereas, in the case of a 0.1 mol/L sulfuric acid, metallic nickel on the auxiliary electrode 12 substantially disappeared by continuously passing electric current for 80 seconds. From this, it was found that sulfuric acid was applicable as the cleaning liquid 31.

The invention claimed is:

1. A plating method comprising:

an electroless plating step for forming a conductive coating on a non-conductive substrate; and an electrolytic plating step for forming a metallic coating on the conductive coating by using an auxiliary electrode, which is arranged to conform to a shape of the non-conductive substrate by a jig, the jig being connected to both the non-conductive substrate and the auxiliary electrode, wherein in the electroless plating step, with a position of the auxiliary electrode adjusted in relation to the non-conductive substrate using the jig, the non-conductive substrate and the auxiliary electrode are both immersed in an electroless plating solution to form the conductive coating, and an electric current is applied while using the auxiliary electrode as an anode and a conductive member immersed in the electroless plating solution as a cathode and without the jig being directly and electrically connected to either of the anode and the cathode, and then in the electrolytic plating step performed after the electroless plating step, with the position of the auxiliary electrode adjusted in relation to the non-conductive substrate using the jig, the non-conductive substrate and the auxiliary electrode are both immersed in an electrolytic plating solution to form the metallic coating on the conductive coating formed in the electroless plating step, and the electric current is applied while using the auxiliary electrode as the anode and a metal plate immersed in the electrolytic plating solution as the anode and with the jig being directly and electrically connected to the cathode.

2. The plating method according to claim 1, wherein, in the electrolytic plating step, the metal plate immersed in the electrolytic plating solution as the anode is a copper plate.

3. The plating method according to claim 1, wherein the jig, the non-conductive substrate and the auxiliary electrode are integrated into an integrated object, and the integrated object is transferred between the electroless plating step and the electrolytic plating step.

4. The plating method according to claim 1, wherein the electroless plating step is performed free of the jig being connected by electrical wiring to either of the anode and the cathode, and the electrolytic plating step is performed with the jig being connected to the cathode by electrical wiring.

5. A plating method comprising:

an electroless plating step for forming a conductive coating on a non-conductive substrate; and an electrolytic plating step for forming a metallic coating on the conductive coating by using an auxiliary electrode, wherein prior to the electroless plating step, a position of the auxiliary electrode is adjusted to conform with a shape of the non-conductive substrate by a jig, the jig being connected to both the auxiliary electrode and the non-conductive substrate, in the electroless plating step, with the position of the auxiliary electrode being adjusted to conform with the shape of the non-conductive substrate using the jig, immersing both the auxiliary electrode and the non-conductive substrate into an electroless plating solution and forming the conductive coating, while applying an electric current to the electroless plating solution using the auxiliary electrode as an anode and a conductive member immersed in the electroless plating solution as a cathode and without the jig being directly and electrically connected to either of the anode or the cathode, and in the electrolytic plating step, with the position of the auxiliary electrode being adjusted to conform with the shape of the non-conductive substrate using the jig, immersing both the auxiliary electrode and the non-conductive substrate into an electrolytic plating solution and forming the metallic coating on the conductive coating formed in the electroless plating step while applying the electric current to the electrolytic plating solution using the auxiliary electrode as the anode and a metal plate immersed in the electrolytic plating solution as the anode and while the jig is directly and electrically connected to the cathode.

6. The plating method according to claim 5, wherein in the electrolytic plating step, the metal plate immersed in the electrolytic plating solution as the anode is a copper plate.

7. The plating method according to claim 5, wherein the jig, the auxiliary electrode and the non-conductive substrate are combined together into an integrated object with the position of the auxiliary electrode adjusted to conform with a shape of the non-conductive substrate, and the integrated object is transferred between the electroless plating step and the electrolytic plating step.

8. The plating method according to claim 5, wherein the electroless plating step is performed free of the jig being connected by electrical wiring to either of the anode and the cathode, and the electrolytic plating step is performed with the jig being connected to the cathode by electrical wiring.

* * * * *